US005468218A

United States Patent [19]

Ward

[11] Patent Number: 5,468,218

[45] Date of Patent: Nov. 21, 1995

[54] FOREHEAD STIMULATOR APPARATUS

[76] Inventor: James K. Ward, 3839 Ryans Lake Ter., Cumming, Ga. 30130

[21] Appl. No.: 199,712

[22] Filed: Feb. 22, 1994

[51] Int. Cl.[6] ..... A61H 7/00

[52] U.S. Cl. ..... 601/144; 601/101

[58] Field of Search ..... 601/51, 84, 97, 601/101, 103, 104, 105, 136, 143, 144–147; 128/DIG. 15; 602/74; 606/99

[56] References Cited

U.S. PATENT DOCUMENTS

| | | | |
|---|---|---|---|
| 849,844 | 4/1907 | Laurence . | |
| 2,103,956 | 12/1937 | Schumacher | 601/144 |
| 3,272,023 | 11/1964 | Ferguson | 601/101 |
| 4,469,092 | 9/1984 | Marshall . | |
| 5,081,986 | 1/1992 | Cho . | |
| 5,097,822 | 3/1992 | Francis | 601/144 |
| 5,115,769 | 5/1992 | Florini . | |
| 5,311,860 | 5/1994 | Doria | 601/103 |

*Primary Examiner*—Robert A. Hafer
*Assistant Examiner*—David J. Kenealy
*Attorney, Agent, or Firm*—Kenneth S. Watkins, Jr.

[57] ABSTRACT

A Sensory Stimulation Apparatus is disclosed with 9 stimulator beam which fits across the forehead and contains a stimulator belt with stimulator elements such as fingers. A rotating lever on one side of the forehead pulls the stimulator belt across the forehead; a return spring on the other side of the forehead pulls the stimulator belt back across the forehead. The strip onto which the stimulator fingers are formed can be attached by a hook and loop fastener which permits the user to replace the finger strip and thereby change the configuration of the stimulator fingers. The amount of contact pressure may be changed by an adjustable strap which supports the apparatus from the head. A voltage control permits user to alter the speed of the stimulation action. The apparatus may be easily reconfigured to stimulate other body parts by altering the shape of the stimulator beam and modifying the support strap to support the apparatus.

4 Claims, 4 Drawing Sheets

Fig- 7
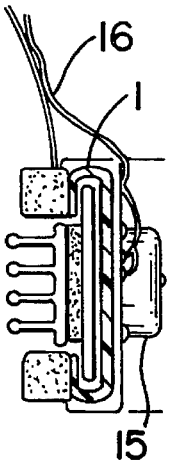
Fig- 6
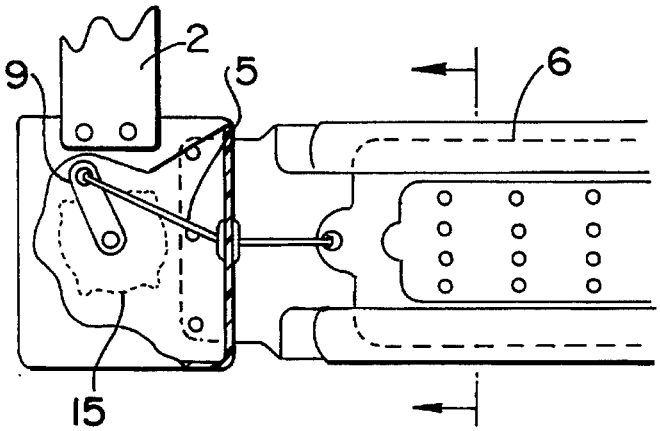
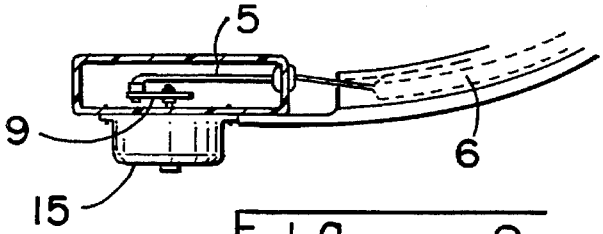
Fig- 8
Fig- 9
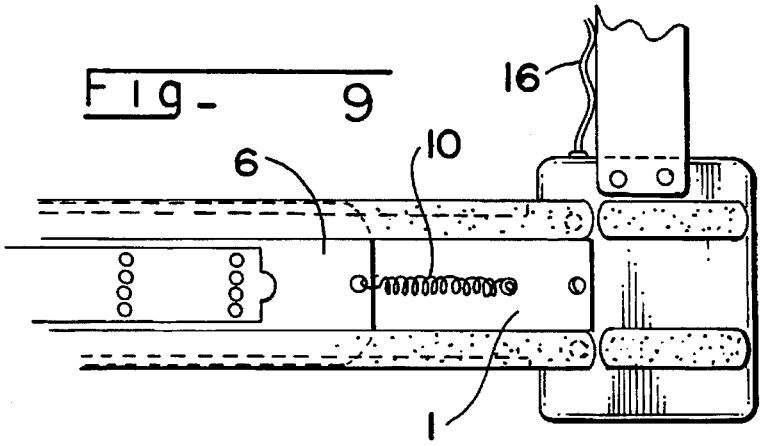
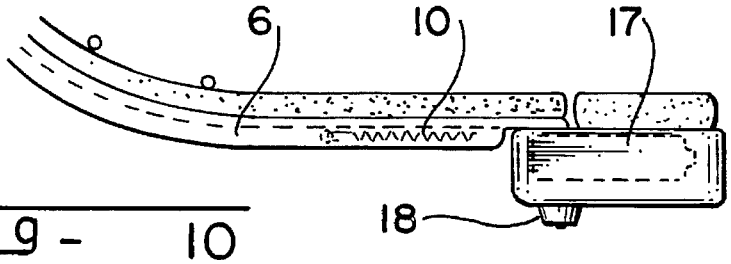
Fig- 10

FOREHEAD STIMULATOR APPARATUS

BACKGROUND AND SUMMARY OF THE INVENTION

The present invention relates to a sensory stimulation apparatus designed to help alleviate pain, stress, tension and headaches using the principle of distraction.

A vast majority of the population suffers from stress, tension and headaches, with many headaches being stress and tension related. Furthermore, a vast majority of the population also experience muscle pain, joint pain and other body pains. Comprehensive research and experimentation has found that lightly stimulating the forehead and other body parts in a back and forward multi-fingered motion can help relieve stress, tension, headaches and body pain. By controlling the exact amount of pressure and variable contact of the different types of stimulator finger attachments, a pleasurable sensory impulse is created which opposes existing pain related impulses, resulting in a distraction that substantially inhibits pain.

In an attempt to relieve tension, stress, headaches and body pains many people rely on prescription or over-the-counter drugs which provide varying degrees of pain relief, but also can cause addiction and other adverse side effects, not to mention the ongoing expense of replenishing supplies. Stimulator therapy is an alternative to drugs, but access to a professional for stimulator therapy is time consuming and expensive as well as inconvenient. In the absence of prescription or over the counter drugs, or of a masseur/masseuse, many people resort to other vices such as alcohol or illicit drugs to rid themselves of pain, headaches, stress and tension.

A number of devices have been disclosed in the past which aim to relieve tension or headaches. Prior art includes vibrators for the scalp or temples, as well as massaging or combing devices for the scalp.

Vibrators and stimulators offer a rubbing or kneading action which differs substantially from the feel of the sensory stimulator. The vibrator and stimulator devices also operate on a different principle which is to promote relaxation and pain relief by vigorously rubbing or kneading to improve circulation. In contrast, the sensory stimulator operates on the principle of distraction by providing a variable contact, highly sensual sensory stimulus, which acts as an opposing force or distraction to inhibit pain.

Other previous patents disclose stimulator or combing-devices designed for the scalp. Current scalp stimulator devices are complicated and cumbersome. They are relatively heavy and, in some cases, require attachment to additional motors and/or power supplies. Current scalp stimulator devices do not provide the flexibility of adjustable speed controls, adjustable pressure and contact points and the ability to quickly replace the stimulator configuration to alter the stimulator characteristics of the device. Also the scalp stimulator devices are not designed to address pain in other parts of the body (i.e. arm, leg, neck, etc.).

Individuals who suffer from headaches, stress, tension and body pain need a simple, portable, light-weight device for stimulating the forehead and other body parts to create an opposing force or distraction to inhibit pain and induce a more relaxed and pleasant state. This device should be designed to accommodate each individual and pain type by offering the flexibility to alter the characteristics and sensation of the stimulation by adjusting the speed of the stimulation action, by adjusting the contact pressure of the stimulator nipples and fingers, and/or changing the stimulation nipple or finger type or arrangement.

My invention is a simple, portable, lightweight apparatus designed to stimulate the forehead for the relief of pain, stress tension, or headaches using the principle of distraction to inhibit pain. The apparatus allows for the flexibility to change the type or configuration of the stimulator nipples or fingers, the amount of contact pressure of the stimulator nipples or fingers, and the speed of the sensory stimulation action.

The apparatus consists of a semi-circular housing or stimulator beam which fits across the forehead. This stimulator beam contains an elongated, flexible stimulator belt onto which is formed a group of stimulator elements such as fingers. The stimulator belt, with its stimulator fingers, oscillate back and forth across the forehead to deliver a highly sensual stimulating action. The stimulator fingers extend from the strap through a foam pad to protrude approximately ⅛ inch beyond the foam pad and can be changed as the need dictates. An adjustable support strap supports the stimulator beam in contact with the forehead, allowing adjustment of the amount and force of contact to suit each case and individual.

The stimulator belt may be integrated with the stimulator fingers as one unit or the stimulator belt may consist of two pieces, a drive belt and a finger strip. If the stimulator belt is made up of a drive belt and a finger strip, the finger strip attaches to the drive belt by means of a hook and loop fastener which permits the user to easily change the finger strip and, thereby, change the configuration of the stimulator fingers and the characteristics of the stimulation sensation.

The drive unit of the apparatus fits over the left temple of the user. The drive side contains a rotating lever driven by a D.C. gear motor which pulls the stimulator belt across the forehead.

The energy source such as a battery pack is located over the right temple of the user. This right side of the apparatus also includes a return spring which opposes the rotating lever on the drive side to pull the stimulator belt back across the forehead of the user.

The apparatus may be easily modified to address pain in other body parts such as the neck, arm, and leg. The shape of the support beam and support means would be modified to provide stimulating action to the applicable area.

My invention is a simple, portable, lightweight apparatus which provides stimulation and pleasurable sensory impulse; creating for the user a state of relaxation and distraction from existing pains, and acting as a substantial pain inhibitor. It allows the user to alter the characteristics and feel of the stimulation by varying the speed of the stimulator action, by varying the amount of contact of the stimulator fingers, or by changing the type and configuration of the stimulator fingers.

BRIEF DESCRIPTION OF THE DRAWINGS

These and other features, aspects, and advantages of the present invention will become better understood with regard to the following description, appended claims, and accompanying drawings where:

FIG. 6 shows an elevation of the drive side of a Sensory Stimulator Apparatus;

FIG. 7 shows a cross-section of the drive side of a Sensory Stimulator Apparatus as indicated in FIG. 5;

FIG. 8 shows a bottom cross-sectional view of FIG. 6;

FIG. 9 shows an elevation view of the return spring side of a Sensory Stimulator Apparatus;

FIG. 10 shows a plan of the return spring side of a Sensory Stimulator Apparatus.

DETAILED DESCRIPTION

The stimulator belt is defined as a flexible belt onto which stimulator elements such as stimulator fingers are formed or attached; the stimulator belt oscillates back and forth across the forehead in response to the opposing forces of the rotating lever on the drive side and the return spring on the other side. The stimulator belt may be integrated with the stimulator fingers as one unit or the stimulator belt may be made up of a drive belt and a stimulator element strip such as a finger strip. A drive belt is defined as a flexible belt which oscillates back and forth across the forehead in response to the opposing forces of the rotating lever on the drive side and the return spring on the opposite side and which has a hook and loop fastener strip onto which the finger strip may attach. The finger strip is defined as a flexible strip; stimulator fingers are formed or attached onto the front side of the finger strip and a hook and loop fastener strip is attached to the back side to allow for attachment of the finger strip to the drive belt.

Figure 1:
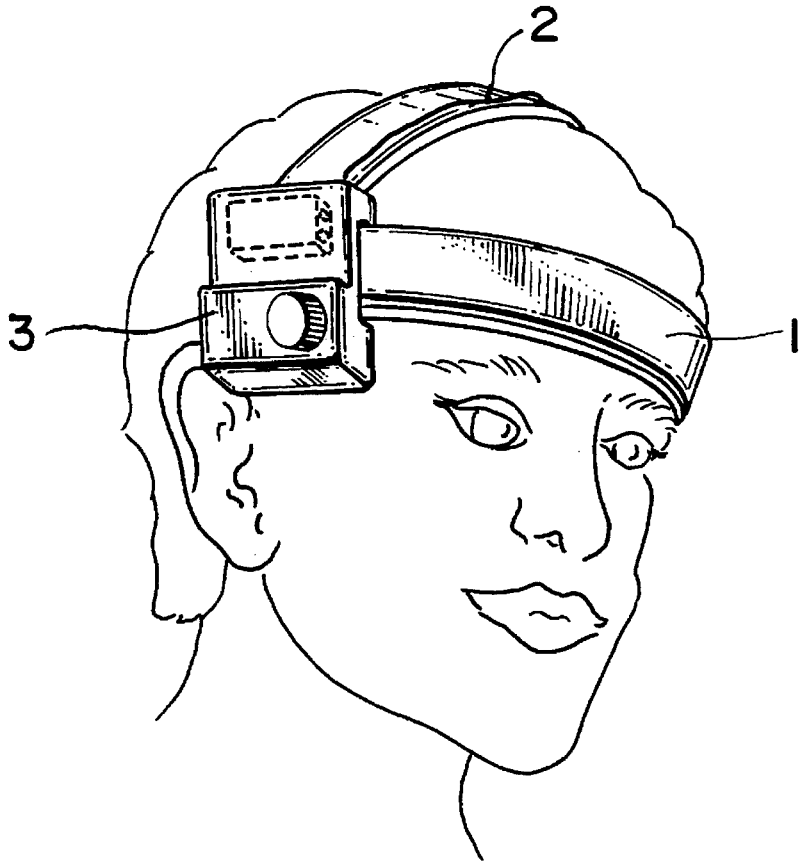
FIG. 1 shows a perspective view of a user wearing a Sensory Stimulator Apparatus.
Figure 2:
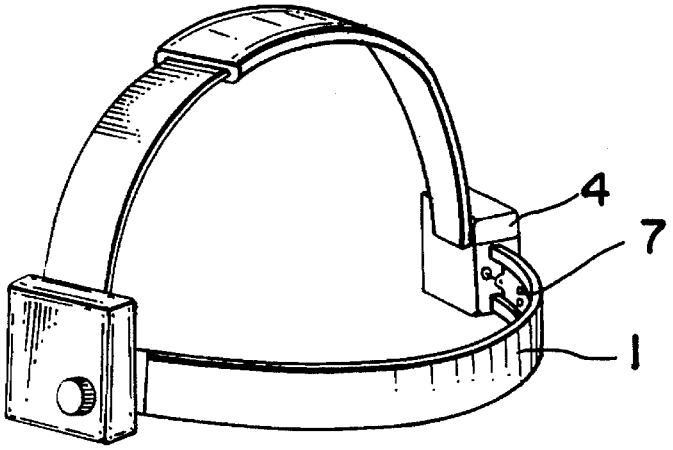
FIG. 2 shows a perspective view of a Sensory Stimulator Apparatus.

As shown in FIG. 1, the Forehead Stimulator Apparatus is worn with the stimulator beam 1 across the forehead and the support strap 2 across the top of the head. The battery pack 3 fits over the right temple. As shown in FIG. 2, the drive unit 4 would fit over the left temple of the user and the stimulator belt with its stimulator fingers 7 fit inside the stimulator beam 1.

Figure 3:
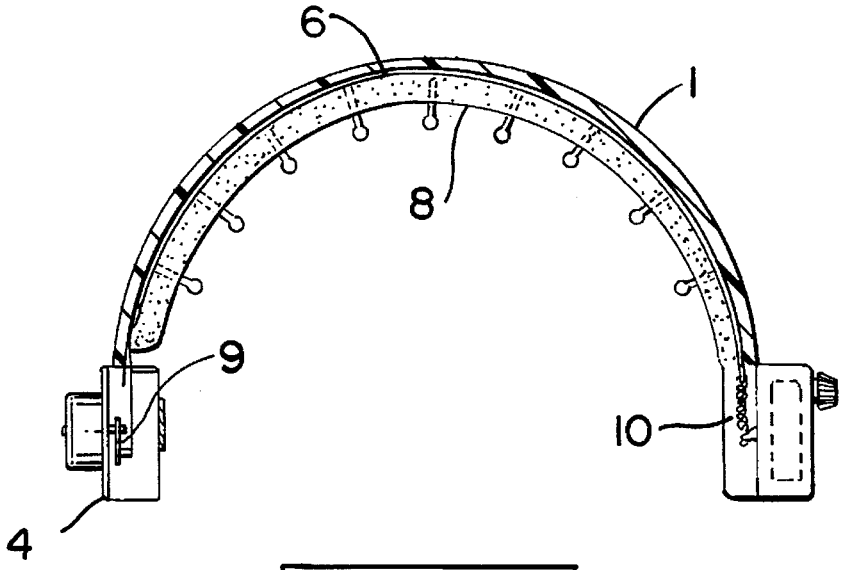
FIG. 3 shows a cross-sectional plan view of one embodiment of a Sensory Stimulator Apparatus.

As shown in FIG. 3, one embodiment of the apparatus consists of a semi-rigid, plastic, semi-circular stimulator beam 1 with a "C" shaped cross-section (see 1 of FIG. 7), a stimulator belt 6, stimulator elements such as stimulator fingers 7, and resilient comfort pad 8. The stimulator beam 1 offers the structure for the forehead assembly. The stimulator fingers 7 are formed or attached onto stimulator belt 6 which oscillates back and forth inside stimulator beam 1. Stimulator fingers 7 protrude approximately ⅛ inch through the opening in stimulator beam 1 and resilient comfort pad 8 as shown in FIG. 3 to contact the forehead. Stimulator belt 6 is attached on the other side of the stimulator beam to return spring 10 which pulls stimulator belt 6 back across the forehead in opposition to rotating lever 9.

Figure 4:
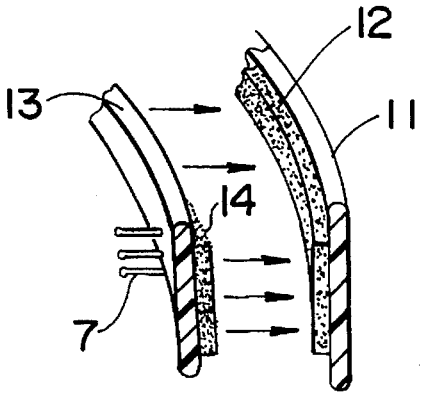
FIG. 4 shows a perspective view of a stimulator belt made up of two pieces, a drive belt and a finger strip.
Figure 5:
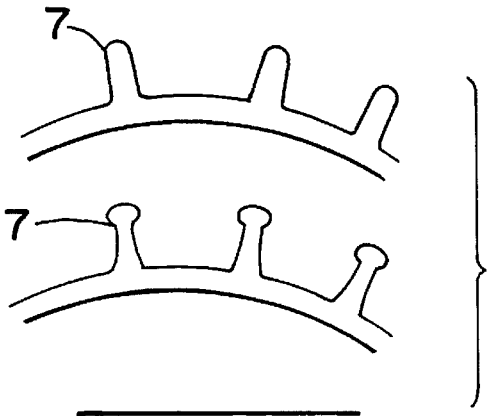
FIG. 5 shows elevations of alternative configurations for the stimulator fingers of the Sensory Stimulator Apparatus.

In its preferred embodiment, stimulator belt 6 consists of two pieces, a drive belt and a finger strip. As shown in FIG. 4, drive belt 11 includes hook and loop fastener strip 12. Finger strip 13 includes matching hook and loop fastener strip 14. Finger strip 13 attaches to drive belt 11 by means of hook and loop fastener strip 12 and matching strip 14. This preferred embodiment allows the user to easily change the finger strip 13 and thereby change the configuration and type of stimulator fingers 7 which changes the characteristics of the stimulator. FIG. 5 shows alternative stimulator fingers 7.

As shown in FIG. 6, stimulator belt 6 is connected to rotating lever 9 by connecting element 5. Rotating lever 9 pulls stimulator belt 6 across the forehead. Rotating lever 9 is run by a small, low R.P.M. motor such as D.C. gear motor 15 shown in FIG. 7. D.C. gear motor 15 attaches to an energy source through wire 16. FIG. 8 shows a bottom cross-section of D.C. gear motor 15, rotating lever 9, connecting element 5, and stimulator belt 6.

FIG. 9 shows return spring 10 connected between stimulator belt 6 and stimulator beam 1. Return spring 10 opposes the rotating lever on the drive unit to pull stimulator belt 6 back across the forehead.

FIG. 10 shows a plan view of the return side, the battery(ies) 17, the return spring 10, and the voltage controller 18. Voltage controller 18 permits the user to turn the apparatus on and off; the voltage controller also allows the user to alter the speed of the stimulating action by varying the voltage applied to the D.C. gear motor. Voltage controller 18 may be a switch combined with a rheostat to vary the voltage supplied to fear motor 15. In its preferred embodiment, it may also utilize a solid state device such as a transistor in a common emitter configuration to improve control and reduce current in the rheostat. Or a "chopper" circuit may be utilized to vary the effective voltage by varying the pulse width of a pulse generator. Wire 16 of FIG. 9 connects voltage controller to D.C. gear motor in the drive side along support strap 2.

Figure 11:
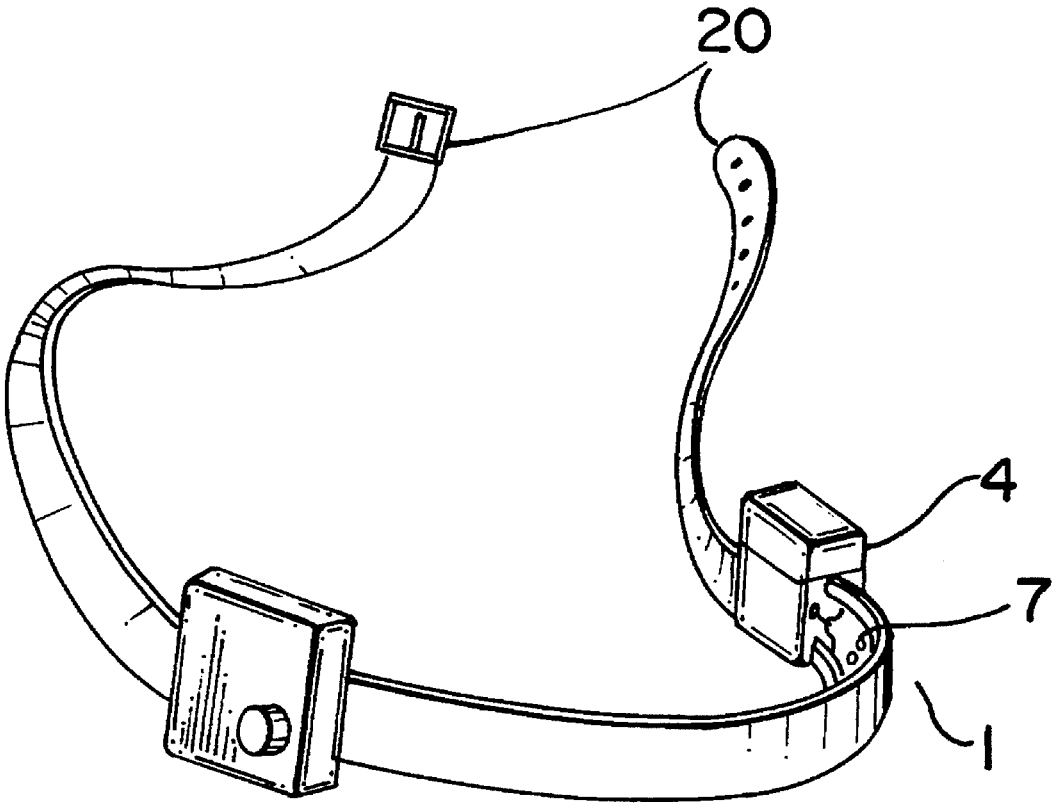
FIG. 11 shows a perspective view of an alternative embodiment of the present invention.

In an alternative embodiment, a second adjustable strap (20 of FIG. 11) would be added to go around the back of the head to more precisely adjust stimulator pressure to the forehead.

Other alternative embodiments convert the apparatus to stimulate the arm, the thigh, the calf, or other body parts. These alternative embodiments change the curvature of the stimulator beam to conform to the shape of the applicable body part. The support strap would fit around the body part to support the apparatus. The support strap would be adjustable to allow easy removal and application, and for adjustment of stimulator finger or nipple contact pressure.

I claim:

1. An apparatus for massaging a human forehead, the apparatus comprising:

(a) an elongated stimulator beam, the beam being desirable generally semi-circular in shape and constructed of a material flexible that the beam follows to the degree at contour of the forehead and when flexed follows a second contour of the forehead, the second contour being different from the first contour, the beam further having a generally "C" shaped cross-section, the cross-section comprising an opening, the opening disposed toward the center of the semi-circular shape;

(b) a stimulator belt comprising a drive belt retained within the cross-section of the beam and constructed of a material flexible to the degree that the drive belt is oscillateable along a longitudinal axis of the beam when the beam follows the first contour and when the beam is flexed to conform with the second contour of the forehead, the stimulator belt further comprising a plurality of stimulator elements constructed of a suitable soft material, the plurality of elements being attached to the drive belt and wherein at least a portion of the stimulator elements protrude through the opening; and (c) an oscillating means for oscillating the stimulator belt along the longitudinal axis of the beam, the oscillating means disposed on the stimulator beam.

2. The apparatus of claim 1 additionally comprising an adjustable strap, the strap being attached to both ends of the beam.

3. The apparatus of claim 1 wherein the plurality of stimulator elements are attached to the drive belt by a removable fastener.

4. The apparatus of claim 1 wherein the stimulator beam is constructed of a plastic material.

* * * * *